US007481172B2

(12) United States Patent
Vaughan

(10) Patent No.: US 7,481,172 B2
(45) Date of Patent: Jan. 27, 2009

(54) VARIABLY SPACED TUFTING NEEDLE ASSEMBLY

(75) Inventor: William N. Vaughan, White, GA (US)

(73) Assignee: Columbia Insurance Company, Omaha, NE (US)

( * ) Notice: Subject to any disclaimer, the term of this patent is extended or adjusted under 35 U.S.C. 154(b) by 281 days.

(21) Appl. No.: 11/452,614

(22) Filed: Jun. 14, 2006

(65) Prior Publication Data

US 2007/0289512 A1 Dec. 20, 2007

(51) Int. Cl.
*D05C 11/04* (2006.01)
*D05C 15/12* (2006.01)

(52) U.S. Cl. ..... 112/80.4

(58) Field of Classification Search ..... 112/80.4–80.45, 112/222, 226

See application file for complete search history.

(56) References Cited

U.S. PATENT DOCUMENTS

| | | | | |
|---|---|---|---|---|
| 3,109,395 | A | 11/1963 | Batty et al. | |
| 3,443,534 | A | 5/1969 | Lund | |
| 4,067,270 | A | 1/1978 | Short | |
| 4,158,339 | A | 6/1979 | Short | |
| 4,217,837 | A | 8/1980 | Beasley et al. | |
| 4,448,137 | A | 5/1984 | Curtis et al. | |
| 4,503,787 | A | 3/1985 | Watkins | |
| 4,519,326 | A | 5/1985 | Green et al. | |
| 4,800,828 | A | 1/1989 | Watkins | |
| 4,841,886 | A | 6/1989 | Watkins | |
| 5,058,518 | A | 10/1991 | Card et al. | |
| 5,193,472 | A | 3/1993 | Crossley | |
| 5,224,434 | A | 7/1993 | Card et al. | |
| 5,549,064 | A | 8/1996 | Padgett, III | |
| 6,014,937 | A | 1/2000 | Lovelady | |
| 6,886,477 | B2 * | 5/2005 | Vaughan et al. | 112/80.4 |
| 7,162,964 | B2 * | 1/2007 | Vaughan et al. | 112/80.4 |

FOREIGN PATENT DOCUMENTS

| | | | |
|---|---|---|---|
| GB | 2255785 | A | 11/1992 |

* cited by examiner

*Primary Examiner*—Ismael Izaguirre
(74) *Attorney, Agent, or Firm*—Ballard Spahr Andrews & Ingersoll, LLP

(57) ABSTRACT

A tufting needle assembly for use with a tufting machine is disclosed that comprises at least one gauge block or needle bar having a row of back gauge elements disposed thereon. The respective back gauge elements are spaced from one another a first distance along a back longitudinal axis. The tufting needle assembly further comprises a row of front gauge elements disposed on the at least one gauge block or needle bar and extending along a front longitudinal axis spaced parallel to the back longitudinal axis. At least one gauge element being spaced from one respective adjacent front gauge element at a distance greater than the first distance.

34 Claims, 8 Drawing Sheets

VARIABLY SPACED TUFTING NEEDLE ASSEMBLY

BACKGROUND OF THE INVENTION

The invention relates in general to tufting machinery. More particularly, the invention relates to a tufting needle assembly featuring at least one tufting needle spaced at an increased distance with respect to an adjacent one of a series of tufting needles disposed along a common longitudinal axis extending along a tufting machine needle bar, or a gauge block adapted for mounting on the needle bar.

FIELD OF THE INVENTION

A tufting machine produces the fibrous face of tufted articles, for example carpets, by tufting individual yarns through a primary backing material or substrate, as known. The tufting machine has a frame supporting at least one elongate needle bar on which at least one series of spaced tufting needles is disposed. A continuous web of backing material is continuously fed in a warp, i.e., a longitudinal or lengthwise, feeding direction through the tufting machine during the tufting process. Each of the tufting needles is threaded with a suitable yarn to be tufted in the backing material, and the needles are passed together through the backing material by the reciprocating motion of the needle bar as the backing material is moved or carried past the needle bar during machine operation to form tufts in the "face" of the backing material. If so desired, and as known, the tufting machine may be provided with two spaced and parallel needle bars, each of which being provided with a separate series of spaced tufting needles.

The needle bar is driven through a suitable drive arrangement such that it is reciprocated vertically with respect to the backing material as it is passed beneath the needle bar during a continuous tufting operation. As appropriate, a looper and/or a knife may be placed on the face side of the backing material, in registry with each respective needle, so that loops or cut piles of tufted yarn are formed and remain in the backing material once the tufting needles are drawn by the needle bar back out of the backing material.

One known type of tufting machine is referred to as an "in-line" type of tufting machine, in which the respective tufting needles disposed on the needle bar are aligned with respect to one another along a common longitudinal axis. It is also known to those skilled in the tufting arts to use two separate needle bars where a separate row of in-line tufting needles is disposed on each needle bar along separate longitudinal axes, respectively. In this arrangement, the longitudinal axes of the two respective rows of tufting needles are parallel to one another and are spaced apart a predetermined distance. Additionally, it is known to align tufting needles of the two respective series or rows of tufting needles with one another in the warp or lengthwise feeding direction of the backing material. In this example, for example and because of the aligned nature of the needles of the respective rows, for a 1/10 gauge tufting machine, i.e., a tufting machine in which there are ten tufting needles per lengthwise inch of the needle bar(s), there will be two rows of 1/10gauge needles, which together comprise a 1/20 gauge fine line tufting machine. This configuration will break up some of the shift marks that will result from the use of in-line rows of tufting needles on the tufting machine, but this will in turn require that the corresponding loopers also be formed into two staggered 1/10 gauge in-line rows as well.

A problem in using this type of tufting machine, in which the respective tufting needles of the two respective series or rows of tufting needles are aligned with respect to one another in the warp or lengthwise feeding direction of the backing material, is that pattern and texture problems associated with the in-line, i.e., the spaced and parallel, rows of tufts formed by the tufting needles become quiet evident in the face of the tufted article. This is especially noticeable on the respective side edge of the web of backing material as it passes through the tufting machine. This is a result of the web warping inwardly at the respective edges of the backing caused by the interaction of the engagement of the tufting needles with the backing. The inward web warping causes the back row of the tufting needles to be slightly offset with respect to the tufts formed by the front row of needles, which results in a distinct and undesirable loss of the desired "in-line" look of the carpet being tufting in a conventional in-line tufting machine. The flawed outer edge areas of the griege good must then be removed as waste materials.

What is needed, therefore, is an improved tufting needle assembly or configuration for use with either a single or dual needle bar tufting machine, and in which the needle bars may be laterally fixed or capable of being shifted, that will minimize the prospect of the aforementioned pattern and/or texture problems resulting in the tufted face of the article(s) being produced.

SUMMARY OF THE INVENTION

The present invention overcomes some of the design deficiencies of the known art by providing a tufting needle assembly, or configuration, for use with a tufting machine. The inventive tufting needle assembly, as described herein, provides for a substantially linear tuft implantation in a tufted backing material for achieving a better tufted surface texture across the width of the backing material.

In one embodiment, this is accomplished by providing the disclosed and inventive tufting needle assembly for use with a conventional tufting machine having a frame, a bed rail supported on the frame, a continuous web of backing material passed over the bed rail and through the tufting machine in a feeding direction, and at least one drive roll for moving the web of backing material through the tufting machine. In one aspect, at least one elongate needle bar is positioned on the machine frame for reciprocating the needle bar toward and away from the backing material. The at least one elongate needle bar has a midpoint and a pair of opposed outer ends.

In one aspect, the tufting needle assembly of the present invention comprises a row of back gauge elements disposed on the at least one needle bar such that each back gauge element is spaced from adjacent back gauge elements along a back longitudinal axis that extends along the lengthwise dimension of the at least one needle bar. In this aspect, each back gauge element is spaced from an adjacent back gauge element at a first distance.

In a further aspect, the tufting needle assembly comprises a row of front gauge elements disposed on the at least one needle bar along a front longitudinal axis. In this aspect, each front gauge element is spaced from an adjacent front gauge element at least the first distance. In another aspect, at least one front gauge element is spaced from one respective adjacent front gauge element at a distance greater than the first distance. Further, it is contemplated that the front longitudinal axis is positioned substantially parallel to and forward of the back longitudinal axis relative to the feeding direction of the tufting machine.

In another aspect, the tufting needle assembly further comprising a first plurality of loopers configured to operatively engage the plurality of front gauge elements and a second plurality of loopers configured to operatively engage the plurality of back gauge elements.

Other apparatus, methods, and aspects and advantages of the invention will be discussed with reference to the Figures and to the detailed description of the preferred embodiments.

BRIEF DESCRIPTION OF THE DRAWINGS

The accompanying drawings, which are incorporated in and constitute a part of this specification, illustrate several aspects described below and together with the description, serve to explain the principles of the invention. Like numbers represent the same elements throughout the figures.

DETAILED DESCRIPTION OF THE INVENTION

Figure 1:
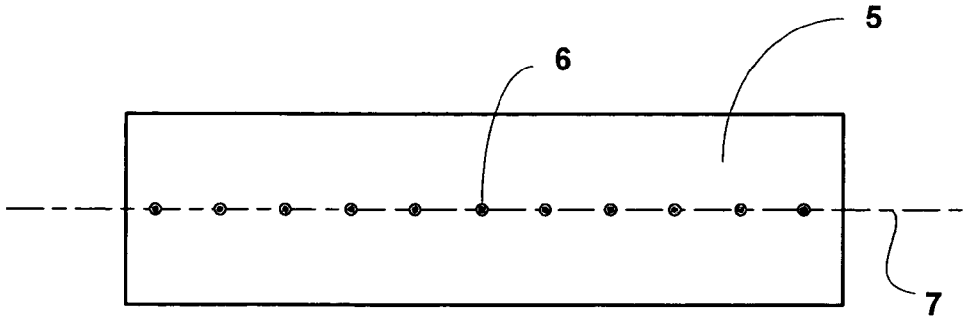
PRIOR ART FIG. 1
FIG. 1 is a schematic illustration of a first known type of tufting needle bar.

The present invention can be understood more readily by reference to the following detailed description, examples, drawing, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a tufting needle" can include two or more such tufting needles unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Four different known types of needle bar designs are commonly used in the tufting process and are illustrated in FIGS. 1-4. The simplest design is an in-line needle bar 5 of the type illustrated schematically in FIG. 1, in which each of the respective tufting needles 6 is positioned along a common longitudinal axis 7 extending in the lateral, or weft, direction of the tufting machine relative to the longitudinally (warp) moving backing material (not illustrated). In one exemplary aspect, the tufting needles can be uniformly spaced a tenth (1/10) of an inch apart from one another such that this configuration is known as a 1/10 gauge needle bar. Examples of in-line needle bars of this type are disclosed in U.S. Pat. Nos. 3,109,395 and 4,217,837, respectively, each of which is incorporated herein in their entirety by this reference.

Figure 2:
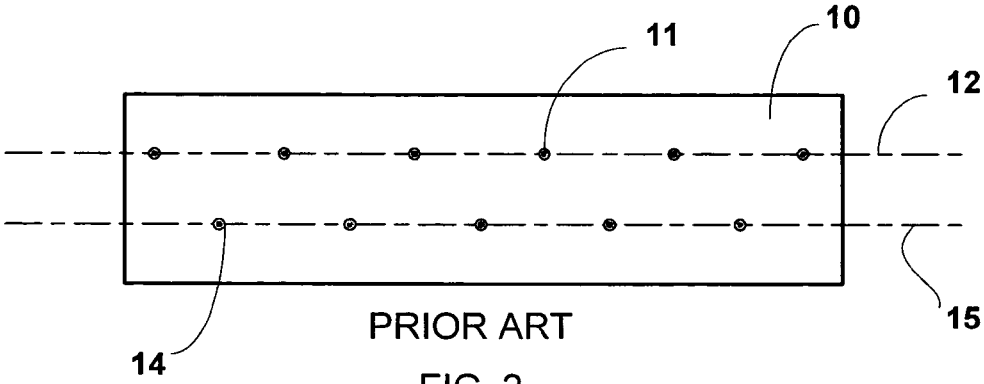
PRIOR ART FIG. 2
FIG. 2 is a schematic illustration of a second known type of tufting needle bar.

A second known type of needle bar design is a "staggered" needle bar as illustrated in FIG. 2. Here a needle bar 10 is provided having a first row or series of spaced tufting needles 11 extending along first longitudinal axis 12, and a second row or series of spaced tufting needles 14 extending along a second longitudinal axis 15. As shown, each of the respective tufting needles is staggered in the longitudinal, or warp, direction from the adjacent needle along either the first longitudinal axis 12 or the spaced and parallel second longitudinal axis 15. So constructed, the staggered needle bar forms two parallel rows of needles in which every other tufting needle is in a different row.

In the staggered construction illustrated in FIG. 2, there is typically a minimum quarter (1/4) of an inch distance or "stagger" between the two rows of tufting needles. Additionally, the tufting needles in each of the two separate rows of needles are spaced from one another laterally a distance of one fifth (1/5) of an inch in the weft direction, which results in the needle bar having a gauge of one tenth (1/10) of an inch, i.e., a ten gauge tufting machine. Examples of this type of a staggered needle bar construction are disclosed in U.S. Pat. Nos. 3,443,534; 4,067,270; 4,158,339; 4,448,137; 4,503,787; and 4,519,326, respectively, each of which is incorporated herein in their entirety by this reference.

Figure 3:
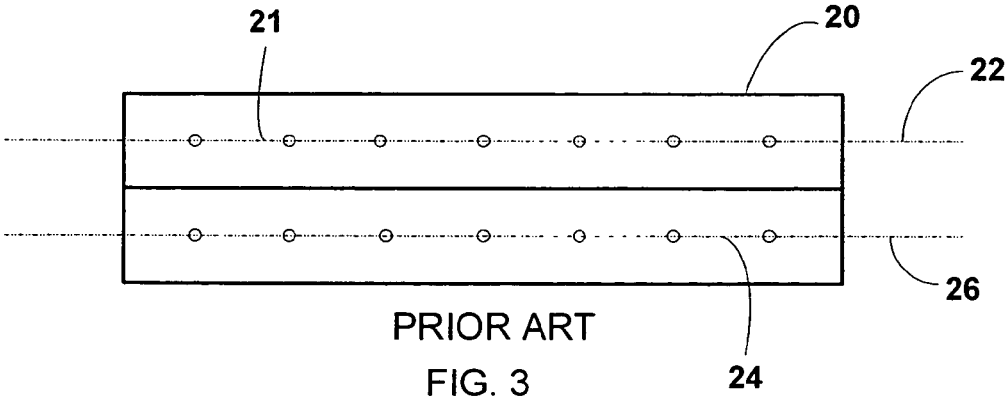
PRIOR ART FIG. 3
FIG. 3 is a schematic illustration of a third known type of tufting needle bar.

A third known type of needle bar design is a non-staggered needle bar as illustrated in FIG. 3. In this example, a needle bar 20 is provided having a first row or series of spaced tufting needles 21 extending along first longitudinal axis 22, and a second row or series of spaced tufting needles 24 extending along a second longitudinal axis 25. As shown, each of the respective tufting needles of the first row are aligned with respective tufting needles of the spaced and parallel second row with respect to the feeding direction of the tufting machine. So constructed, the staggered needle bar forms two parallel rows of needles in which respective pairs of needles are aligned in the feeding direction of the tufting machine.

As one would expect, in the non-staggered construction illustrated in FIG. 3, the spacing between the adjacent needles in both of the first and second rows is uniform. In one exemplary aspect, the tufting needles can be uniformly spaced a tenth (1/10) of an inch apart from one another such that this configuration would be considered a 1/20 gauge needle bar. An example of this type of a needle bar construction are disclosed in U.S. Pat. No. 4,800,828, which is incorporated herein in its entirety by this reference. An example of a tufting machine that uses this type of a staggered needle bar construction is manufactured by TUFTCO, Serial No. 604762224-B, 1/16-EFL-15'-4G, Model No. 1/16 186 0204-L.

Figure 4:
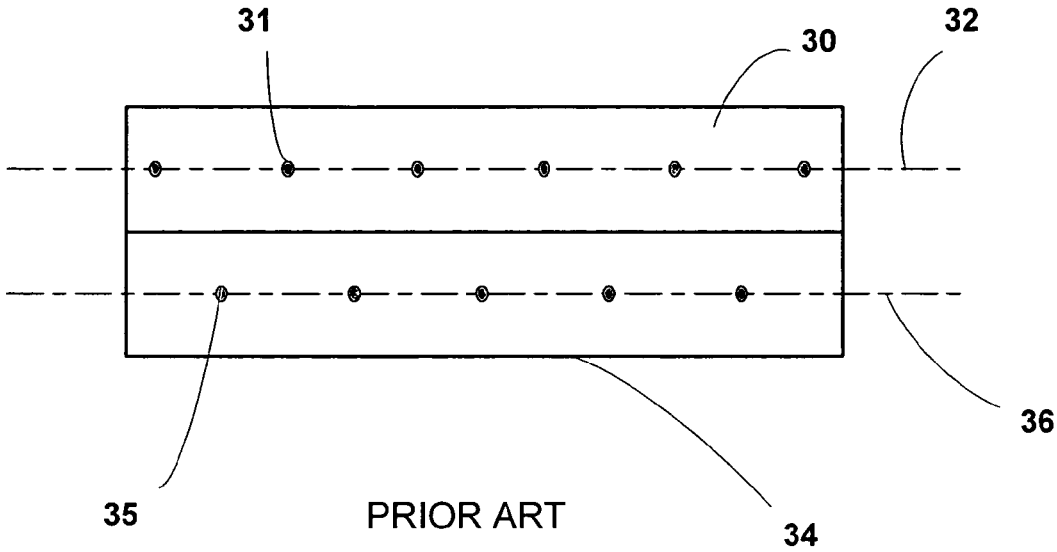
PRIOR ART FIG. 4
FIG. 4 is a schematic illustration of fourth known type of tufting needle bar.

A fourth known type of tufting machine needle bar design is illustrated in FIG. 4, and is known to those skilled in the art as a graphic needle bar, a double needle bar, or a dual needle bar design. This needle bar design has two spaced and parallel needle bars rather than a single needle bar that forms either an in-line (FIG. 1), a staggered (FIG. 2), or a non-staggered (FIG. 3) needle bar design. The two separate needle bars of this third design, a first needle bar 30 and a second needle bar 24, together are similar to the needle bar of FIGS. 2 and 3 in that two separate series or rows of tufting needles 31, 35, respectively, are provided, only here there is only one row of tufting needles on each of the two needle bars. As one will appreciate, the tufting needles can be configured in either the staggered or non-staggered design. As illustrated, the tufting needles 31 lie along a first, or front, common longitudinal axis 32, and the tufting needles 35 lie along a second, or back, common longitudinal axis 36 spaced from and parallel to the first axis. The two axes 35, 36 are spaced a predetermined distance from each other such as, for example and not meant to be limiting, about one quarter (1/4) of an inch from one another.

If the tufting machine on which the two needle bars 30, 31 are supported operates so that there is no relative (lateral) motion between the two needle bars, the needle bars of FIG. 4 will be used exactly the same as the staggered or non-staggered needle bars of FIGS. 2 and 3. If, however, the two needle bars are independently shifted or moved laterally relative to each other in the weft direction of the backing material (not illustrated), significantly more tufting patterns can be formed. Examples of graphic needle bar designs are disclosed in U.S. Pat. Nos. 4,841,886; 5,058,518; 5,193,472; 5,224,434; 5,549,064; and 6,014,937, and in UK Patent Application GB 2,255,785, respectively, each of which is incorporated herein in their entirety by this reference.

Figure 5A:
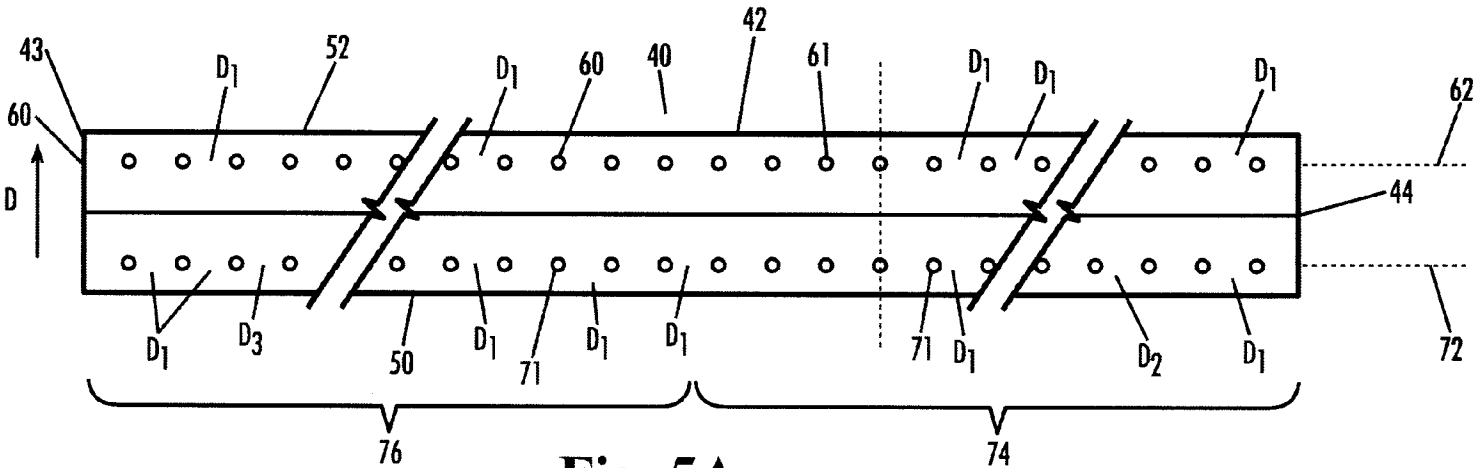
FIG. 5A is a schematic illustration of a first embodiment of the tufting needle assembly of the present invention.
Figure 5B:
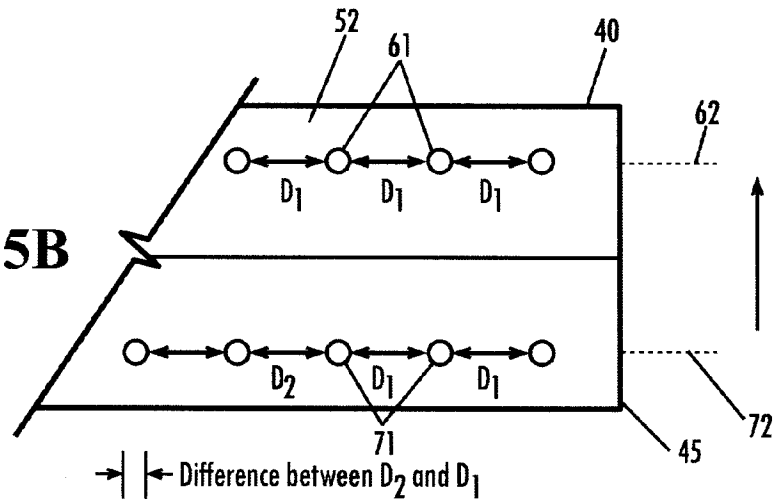
FIG. 5B is a partial enlarged view of an end portion of the tufting needle assembly of FIG. 5A.

Referring now to FIG. 5A-10, several embodiments of the inventive tufting needle assembly of this invention are illustrated. Referring first to FIGS. 5*a* and 5B, an elongate needle bar or gauge block 40 is illustrated. It is understood by those skilled in the art that either a needle bar or a gauge block can be used with the tufting needle assembly of this invention in that the tufting needles can be affixed directly to the needle bar, as known, or can be formed as a portion of a gauge block, which is constructed in known fashion for being suitably affixed to the needle bar. Accordingly, as used herein, the terms "gauge block" and "needle bar" are interchangeable for the purposes of describing the invention.

Referring to the figures, at least one needle bar 40 is provided that is supported on the frame of the tufting machine and is configured for at least reciprocating motion with respect to the frame. The at least one needle bar has a midpoint 42 and opposed outer ends 43, 44. In one aspect, the at least one needle bar comprised a front needle bar 50 and a back needle bar 52. It will be appreciated that the terms "front" and "back" are used herein to describe the relative position of the respective needles bars in relation to the feeding direction of the carpet web or substrate therethrough the tufting machine.

In one aspect, a row of back gauge elements 60 are disposed on the at least one needle bar 40. Each back gauge element 61 is spaced from adjacent back gauge elements along a back longitudinal axis 62 that extends along the lengthwise dimension of the at least one needle bar. In this aspect, each back gauge element is spaced from an adjacent back gauge element in series along the back longitudinal axis at a first distance D1. Optionally, the first distance can range from between about 0.05 to 0.50 inches, optionally between about 0.125 to 0.25 inches, with between about 0.10 to 0.17 inches being preferred.

In a further aspect, a row of front gauge elements 70 are also disposed on the at least one needle bar 40. In this aspect, each front gauge element 71 is spaced from adjacent front gauge elements along a front longitudinal axis 72 that extends along the lengthwise dimension of the at least one needle bar. In another aspect, the front longitudinal axis is positioned substantially parallel to and forward of the back longitudinal axis relative to the feeding direction of the tufting machine.

Moreover, the needle bar or gauge block 40 can be fashioned as a front needle bar 40 and as a separate back needle bar 45, each of which is independent of the other, and which may optionally be laterally shifted with respect to one another in known fashion. Regardless of whether a single needle bar 40 or a pair of needle bars 40, 45 is used, it is contemplated anticipated that the back longitudinal axis is spaced from the front longitudinal axis in a range from about 0.125 to about 1.00 inches.

In this aspect, each front gauge element 71 is spaced from an adjacent front gauge element at least the first distance. In a further aspect, and as shown in FIG. 5, at least one front gauge element of a first portion 74 of the row of front gauge elements extending from the midpoint 42 to one of the outer ends 44 of the at least one needle bar is spaced from one respective adjacent front gauge element at a second distance D2 that is greater than the first distance D1. Optionally, the second distance can range from between about 0.05 to 0.51, optionally between about 0.125 to 0.25 inches, with between about 0.10 to 0.17 inches, and with 0.150 inches being preferred.

Figure 11:
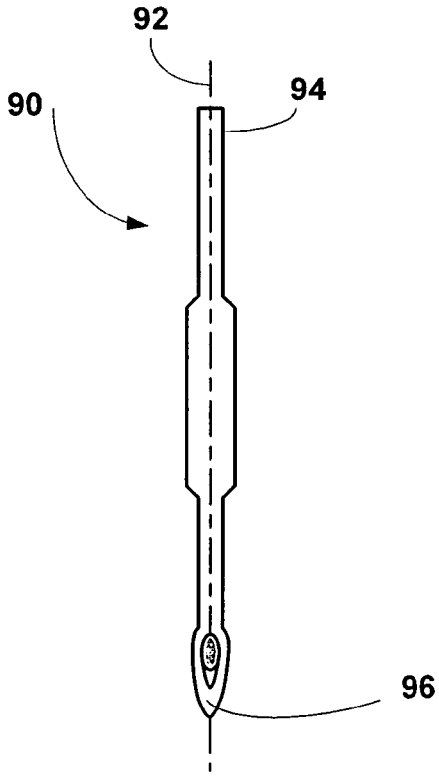
FIG. 11 is an illustration of a conventional tufting needle.

In one aspect, each respective front and back gauge elements 61, 71 comprise a tufting needle 90 as exemplarily shown in FIG. 11. Each tufting needles has an elongate needle shank 92 with a proximal end 94 and a spaced distal end 96 that defines a needle tip. In the figures, it is to be understood that the tufting needles that are illustrated and described are the needle tips of the respective tufting needles. However, it is contemplated that it could also illustrate the junctures of the tufting needles with the underlying needle bar or gauge block. In another example, it is contemplated that the illustrated tufting needles can represent a cross-section of the shank of the tufting needle. The needle bar or gauge block 40 will be constructed in known fashion. If a gauge block rather than a needle bar 40 is used with the tufting needle assembly, the gauge block will be constructed in known fashion so that it can be suitably affixed to the tufting machine needle bar.

In one aspect, the distance between the respective front and back gauge elements 61, 71, i.e., for example, the front and back tufting needles, can be measured between the respective proximal ends of the adjacent gauge elements. Optionally, the distance between the respective adjacent front and back gauge elements can be measured between the respective distal ends of the adjacent gauge elements. In a further aspect, the shanks of the respective tufting needles of each respective row of tufting needles can be aligned with respect to one another such that they extend linearly along their respective front and back longitudinal axis. Optionally, the distal ends or the needle tips of the respective tufting needles of each respective row of tufting needles can be aligned with respect to one another such that they extend linearly along their respective front and back longitudinal axis.

It is again contemplated that the disclosed invention may comprise a front needle bar 40 and a spaced and parallel back needle bar 45, such that the row of front gauge elements 70 is provided on the front needle bar 40 and the row of back gauge elements 60 is provided on the separate back needle bar 45. In various aspects, each needle bar is capable of independent reciprocating motion, in known fashion, toward and away from a backing material (not shown) that passes through the tufting machine, and which also, optionally, may be laterally shifted with respect to one another.

As shown in FIG. 5A, a second portion 76 of the row of front gauge elements extends from the midpoint 42 to one of the outer ends 43 of the at least one needle bar. In this aspect, the second portion of the row of front gauge elements opposes the first portion 74 of the row of front gauge elements. In one embodiment, at least one front gauge element 71 of the second portion 76 of the row of front gauge elements is spaced from one respective adjacent front gauge element at a third distance D3 that is greater than the first distance. In this aspect, it is contemplated that the third distance D3 can be substantially equal to the second distance D2, both of which being greater than the first distance D1. The respective distances of D3 are described above in reference to the distances described for D2. In various aspects, the respective second and third distances can be greater than the first distance in a range of about 0.005 to about 0.050 inches, with about 0.020 to about 0.030 inches being preferred.

Referring of FIGS. 6A-10, optionally, at least one matched pair 80 of front gauge elements 80 is formed from the at least one front gauge element of the first portion 74 of the row of front gauge elements that is spaced from one respective adjacent front gauge element at the second distance and the at least one front gauge element of the second portion 76 of the row of front gauge elements that is spaced from one respective adjacent front gauge element at the third distance. In one exemplary aspect, it is contemplated that each matched pair of front gauge elements 80 can be spaced substantially equidistant from the midpoint of the at least one needle bar.

Figure 6A:
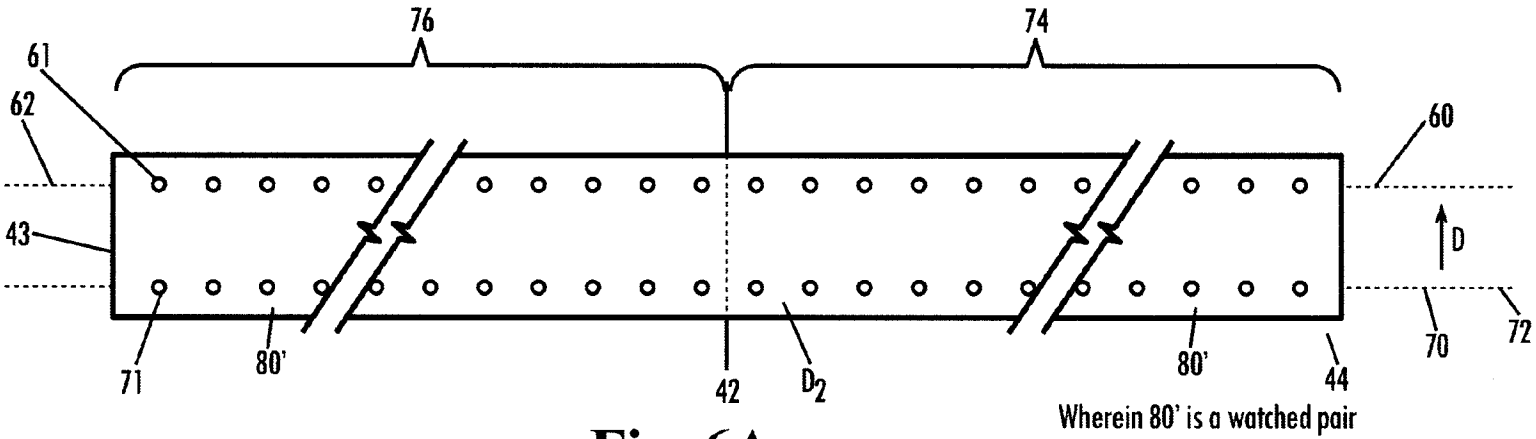
FIG. 6A is a schematic illustration of a second embodiment of the tufting needle assembly of the present invention.
Figure 6B:
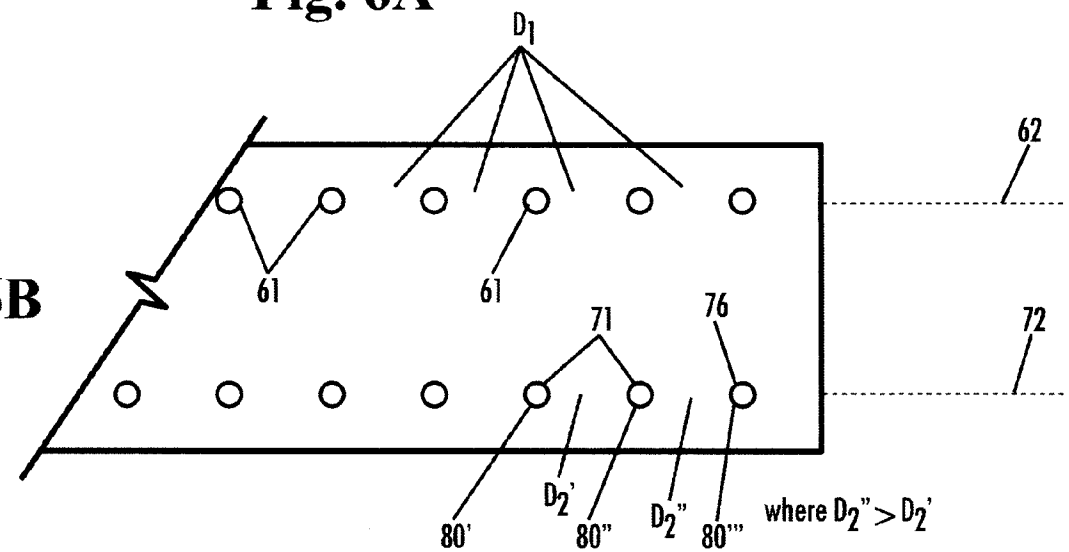
FIG. 6B is a partial enlarged view of an end portion of the tufting needle assembly of FIG. 6A.

In the exemplified aspect illustrated in FIG. 6A, the at least one matched pair of front gauge elements 80 comprises a plurality of matched pairs of front gauge elements. In this example, the distance between the adjacent front gauge elements 71 of each matched pair of front gauge elements increases as the gauge elements of the plurality of matched pairs of front gauge elements extend outwardly along the front longitudinal axis 72. Thus, in one exemplified aspect, the respective distances between adjacent front gauge elements increases as the front gauge elements 71 extend outwardly from the midpoint 42 toward the respective outer ends 43, 44 of the at least one needle bar 40.

Figure 7A:
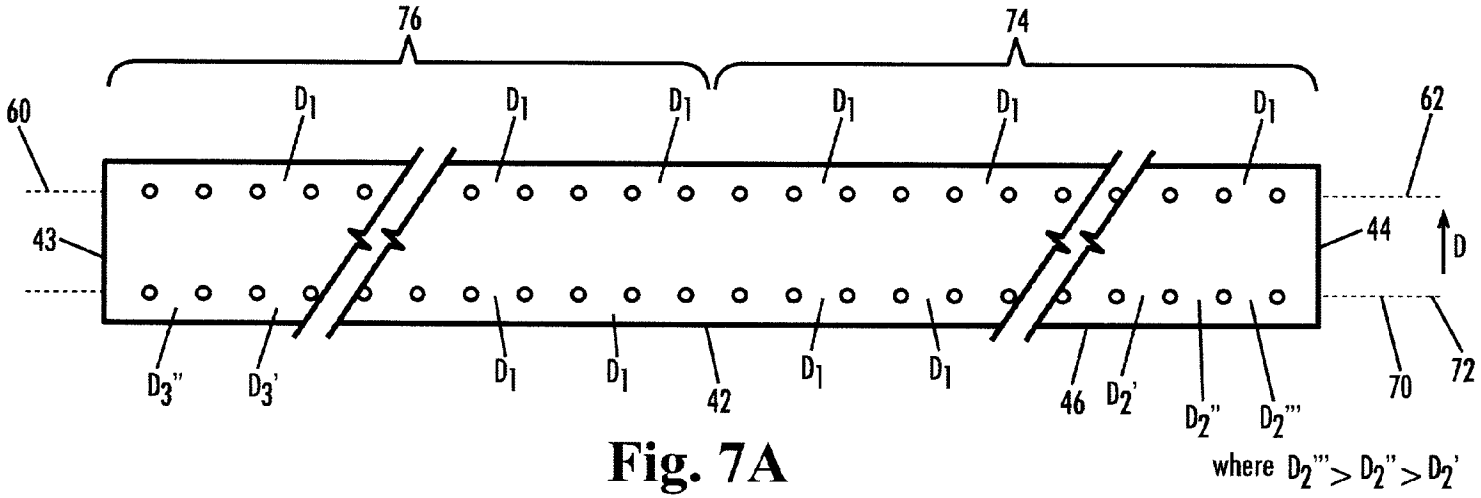
FIG. 7A is a schematic illustration of a third embodiment of the tufting needle assembly of the present invention.
Figure 7B:
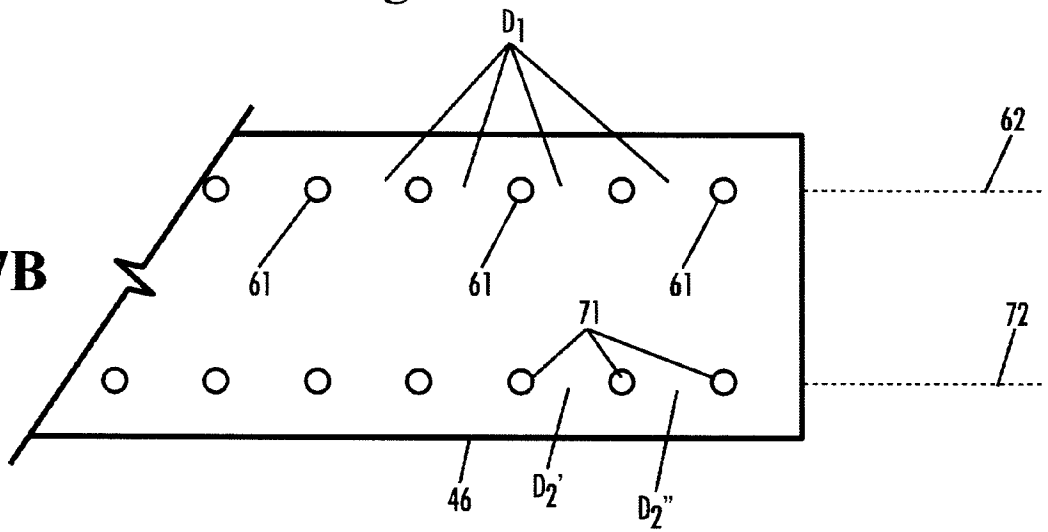
FIG. 7B is a partial enlarged view of an end portion of the tufting needle assembly of FIG. 7A.

Optionally, as shown in FIG. 7A, the plurality of matched pairs of front gauge elements 80 can be positioned on respective outer end portions 46 of the at least one needle bar. In one aspect, it is contemplated that the front gauge elements 71 that extend between the plurality of matched pairs of front gauge elements can be spaced at the first distance. In this aspect, the front gauge elements that extend between the plurality of matched pairs of front gauge elements can also be positioned in-line with respect to their adjacent respective back gauge elements 61 and with respect to the feeding direction of the tufting machine.

Figure 8A:
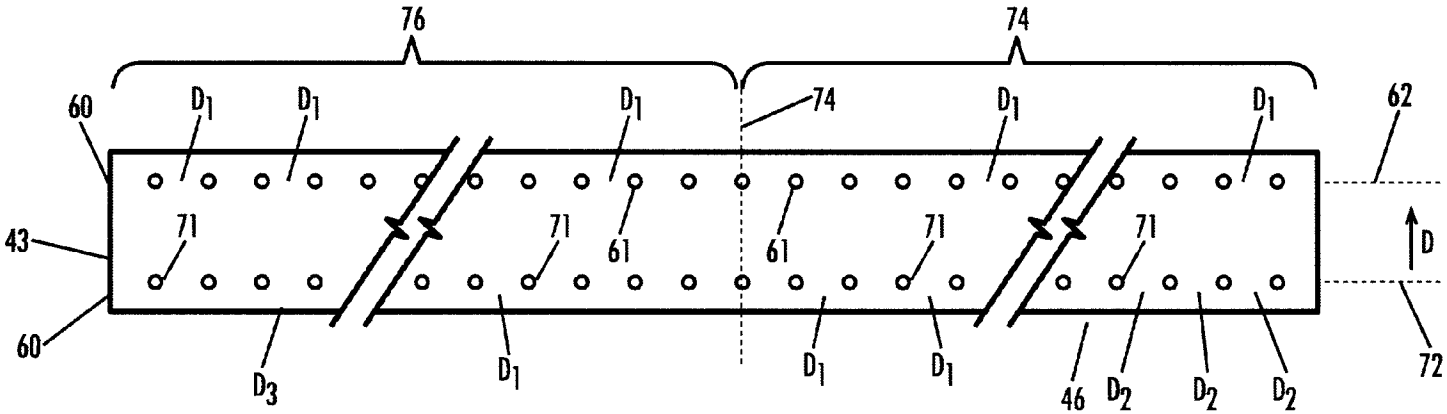
FIG. 8A is a schematic illustration of a fourth embodiment of the tufting needle assembly of the present invention.
Figure 8B:
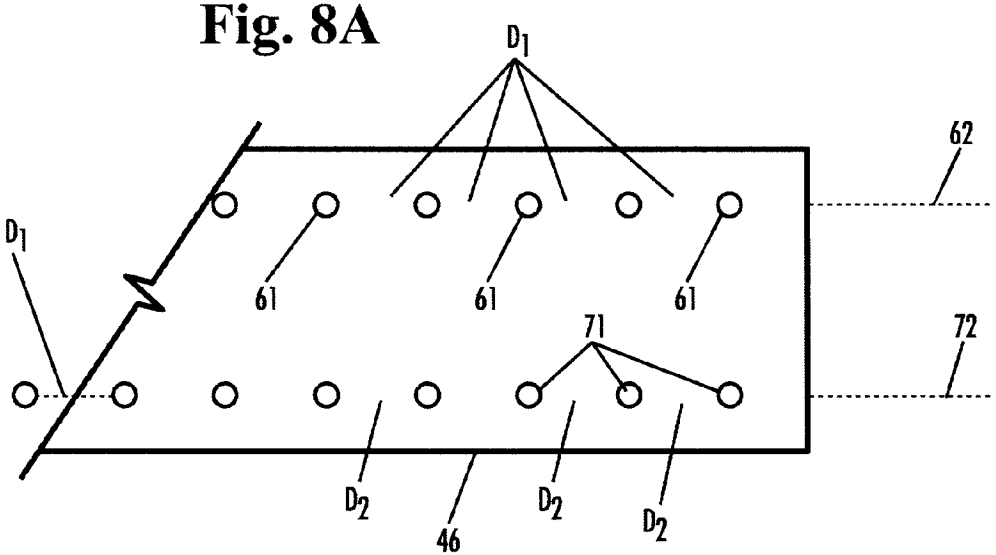
FIG. 8B is a partial enlarged view of an end portion of the tufting needle assembly of FIG. 5A.

In another embodiment and referring now to FIG. 8A, the at least one matched pair of front gauge elements 80 comprises a plurality of matched pairs of front gauge elements in which the distance between adjacent front gauge elements of each matched pair of front gauge elements is substantially the second distance. In the illustrated exemplary aspect, the plurality of matched pairs of front gauge elements are positioned on respective opposite outer end portions 46 of the at least one needle bar 40. It is of course contemplated that the plurality of matched pairs of front gauge elements can be positioned at any desired location along the at least one needle bar.

It is contemplated that the at least one matched pair of front gauge elements can be positioned at least intermediate the midpoint 42 and respective outer ends 43, 44 of the at least one needle bar. It various exemplary aspects, the at least one matched pair of front gauge elements 80 are spaced from the respective outer ends 43, 44 of the at least one needle bar 40 a predetermined distance that can range from less than about 25 to less than about 5 percent of the length of the at least one needle bar, including additional percentages of 24, 23, 22, 21, 20, 19, 18, 17, 16, 15, 14, 13, 12, 11, 10, 9, 8, 7, 6, 5, 4, 3, 2, and 1 percent.

Figure 9:
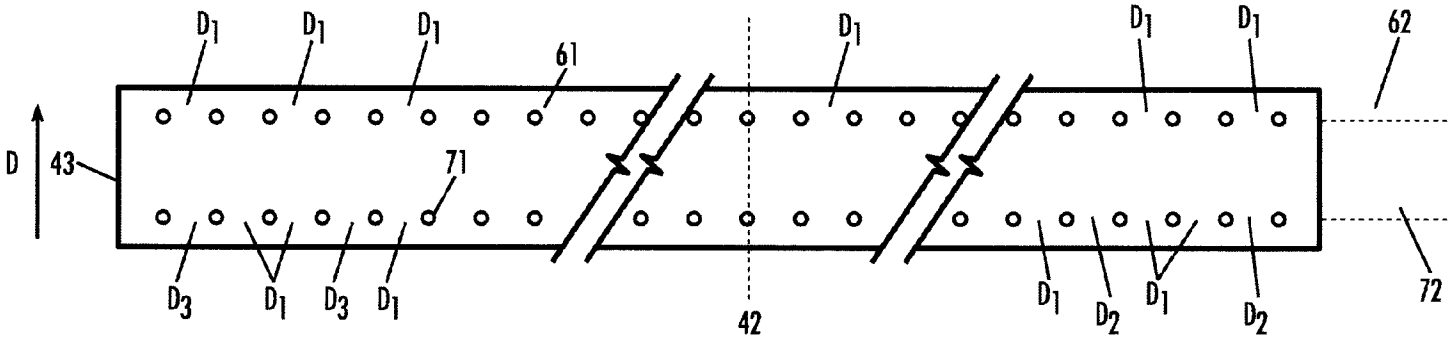
FIG. 9 is a schematic illustration of a fifth embodiment of the tufting needle assembly of the present invention.

Optionally, and as shown in FIG. 5A, the at least one matched pair of front gauge elements 80 comprises one matched pair of front gauge elements. In another aspect, and as shown in FIG. 9, the at least one matched pair of front gauge elements comprises two matched pairs of front gauge elements.

As noted above, it is contemplated that the front gauge elements 71 that extend between the plurality of matched pairs of front gauge elements 80 can be spaced at the first distance. In this aspect, at least some of the front gauge elements that extend between the plurality of matched pairs of front gauge elements can also be positioned in-line with respect to respective back gauge elements and with respect to the feeding direction of the tufting machine. In another aspect, and as one skilled in the art will appreciate, at least some of the front gauge elements that extend between the respective matched pair of front gauge elements and the outer ends of the at least one needle bar are staggered with respect to their adjacent back gauge elements.

It is further contemplated that any combination of aligned tufting needles of the respective rows of front and back gauge elements positioned at any desired spacing along the respective front and back longitudinal axis can be configured for use with the loopers, fingerplates, and/or knives of the tufting machine. In one aspect, a first plurality of loopers (not shown), one for each tufting needle, is conventionally configure to operatively engage the plurality of front gauge elements 71 and a second plurality of loopers (not shown), one for each tufting needle, is conventionally configured to operatively engage the plurality of back gauge elements 61. Thus, it is contemplated that the spacing between the loopers of the first plurality of loopers would be substantially the same as the spacing between the cooperating front gauge elements 71. Similarly, it is contemplated that the spacing between the loopers of the second plurality of loopers would be substantially the same as the spacing between the cooperating back gauge elements 61.

Figure 10:
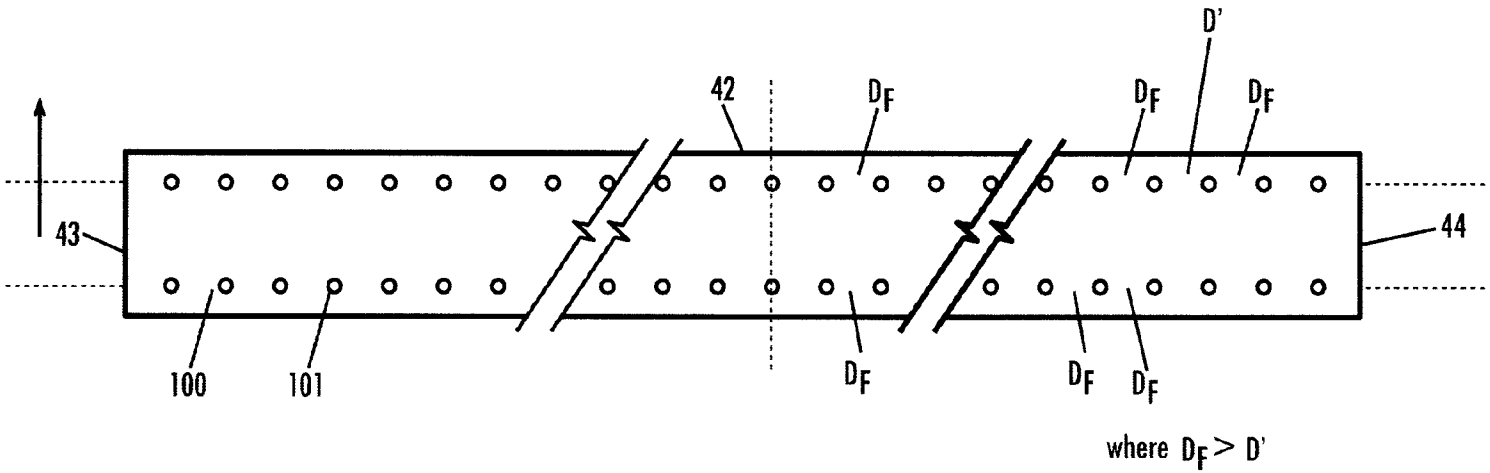
FIG. 10 is a schematic illustration of a sixth embodiment of the tufting needle assembly of the present invention.

Yet another embodiment of the tufting needle assembly of this invention is schematically illustrated in FIG. 10. As shown, at least one elongate needle bar 40 is provided having a row of front gauge elements 100 being positioned thereon such that adjacent front gauge elements 101 are spaced along a front longitudinal axis that extends along the lengthwise dimension of the at least one needle bar. In one aspect, each front gauge element is spaced from an adjacent front gauge element a fixed distance. In a further aspect; a row of back gauge elements 110 positioned thereon the at least one needle bar such that the adjacent back gauge elements 111 are spaced along a back longitudinal axis that extends along the lengthwise dimension of the at least one needle bar. In one aspect, each back gauge element is spaced from an adjacent back gauge element at the fixed distance or less than the first distance. In another aspect, at least one back gauge element is spaced from one respective adjacent back gauge element at a distance less than the fixed distance. In this embodiment, the front longitudinal axis is positioned substantially parallel to and forward of the back longitudinal axis relative to the feeding direction of the tufting machine.

It will be appreciated that the alternative embodiment described above and illustrated in FIG. 10 is substantially the opposite of that described and illustrated in FIGS. 5A-9. However, it is contemplated that the alternative aspects that were exemplary described with the embodiment shown in FIGS. 5A-9 can be readily applied to the alternative embodiment described with reference to FIG. 10.

One skilled in the art will further appreciate another advantage of the present invention which is that the disclosed tufting needle assembly may be easily incorporated into existing tufting machinery. That is, regardless of whether a single or a double needle bar arrangement is used, or whether the tufting needles are affixed to a gauge block which is in turn affixed to the needle bar(s), the difference in spacing between the first and second/third distances of the respective rows of front and back gauge elements 60, 70 is relatively small so that no adjustments are likely necessary to the tufting machine. For example, it is anticipated that the loopers of the tufting machine will not need to be replaced, and will most likely require little or no adjustment when being used on the gauge block(s)/needle bar(s) of the present invention.

Throughout this application, various publications are referenced. The disclosures of these publications in their entireties are hereby incorporated by reference into this application in order to more fully describe the state of the art to which this invention pertains.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is therefore understood that the invention is not limited to the specific embodiments disclosed herein, and that many modifications and other embodiments of the invention are intended to be included within the scope of the invention. Moreover, although specific terms are employed herein, they are used only in a generic and descriptive sense, and not for the purposes of limiting the described invention.

What is claimed is:

1. A tufting needle assembly for use with a tufting machine having a frame and at least one elongate needle bar supported on the frame and configured for reciprocating motion with respect to the frame, the at least one needle bar having a midpoint and opposed outer ends, the tufting machine having a feeding direction for a carpet substrate therethough the tufting machine, the tufting needle assembly comprising:

a row of back gauge elements disposed on the at least one needle bar, each back gauge element being spaced from adjacent back gauge elements along a back longitudinal axis that extends along the lengthwise dimension of the at least one needle bar, wherein each back gauge element is spaced from an adjacent back gauge element a first distance; and a row of front gauge elements disposed on the at least one needle bar, each front gauge element being spaced from adjacent front gauge elements along a front longitudinal axis that extends along the lengthwise dimension of the at least one needle bar, wherein each front gauge element is spaced from an adjacent front gauge element at least the first distance, wherein at least one front gauge element of a first portion of the row of front gauge elements extending from the midpoint to one of the outer ends of the at least one needle bar is spaced from one respective adjacent front gauge element at a distance greater than the first distance, wherein the front longitudinal axis is positioned substantially parallel to and forward of the back longitudinal axis relative to the feeding direction of the tufting machine.

2. The tufting needle assembly of claim 1, further comprising:

a first plurality of loopers configured to engage the plurality of front gauge elements; and a second plurality of loopers configured to engage the plurality of back gauge elements.

3. The tufting needle assembly of claim 2, wherein at least one front gauge element of a second portion of the row of front gauge elements extending from the midpoint to one of the outer ends of the at least one needle bar is spaced from one respective adjacent front gauge element at a distance greater than the first distance, and wherein the second portion of the row of front gauge elements opposes the first portion of the row of front gauge elements.

4. The tufting needle assembly of claim 3, wherein at least one matched pair of front gauge elements is formed from the at least one front gauge element of a first portion of the row of front gauge elements that is spaced from one respective adjacent front gauge element at the distance greater than the first distance and the at least one front gauge element of the second portion of the row of front gauge elements that is spaced from one respective adjacent front gauge element at the distance greater than the first distance, and wherein each matched pair of front gauge elements is spaced substantially equidistant from the midpoint of the at least one needle bar.

5. The tufting needle assembly of claim 4, wherein the at least one matched pair of front gauge elements comprises a plurality of matched pairs of front gauge elements, wherein the distance between adjacent front gauge elements of each matched pair of front gauge elements increases as the gauge elements of the plurality of matched pairs of front gauge elements extend along the front longitudinal axis from the midpoint toward the respective outer ends of the at least one needle bar.

6. The tufting needle assembly of claim 5, wherein the plurality of matched pairs of front gauge elements are positioned on respective opposite outer end portions of the at least one needle bar.

7. The tufting needle assembly of claim 4, wherein the at least one matched pair of front gauge elements comprises a plurality of matched pairs of front gauge elements, wherein the distance between adjacent front gauge elements of each matched pair of front gauge elements is a second distance greater than the first distance.

8. The tufting needle assembly of claim 7, wherein the plurality of matched pairs of front gauge elements are positioned on respective opposite outer end portions of the at least one needle bar.

9. The tufting needle assembly of claim 4, wherein the at least one matched pair of front gauge elements are positioned at least intermediate the midpoint and respective outer ends of the at least one needle bar.

10. The tufting needle assembly of claim 9, wherein the at least one matched pair of front gauge elements are spaced from the respective outer ends of the at least one needle bar a predetermined distance less than 25% of the length of the at least one needle bar.

11. The tufting needle assembly of claim 10, wherein the at least one matched pair of front gauge elements comprises one matched pair of front gauge elements.

12. The tufting needle assembly of claim 11, wherein the front gauge elements extending therebetween the respective matched pair of front gauge elements are positioned in-line with respective back gauge elements with respect to the feeding direction of the tufting machine.

13. The tufting needle assembly of claim 12, wherein the front gauge elements extending between the respective matched pair of front gauge elements and the respective outer ends of the at least one needle bar are staggered with respect to respective back gauge elements.

14. The tufting needle assembly of claim 9, wherein the at least one matched pair of front gauge elements are spaced from the respective outer ends of the at least one needle bar a predetermined distance less than 20% of the length of the at least one needle bar.

15. The tufting needle assembly of claim 9, wherein the at least one matched pair of front gauge elements are spaced from the respective outer ends of the at least one needle bar a predetermined distance less than 15% of the length of the at least one needle bar.

16. The tufting needle assembly of claim 9, wherein the at least one matched pair of front gauge elements are spaced from the respective outer ends of the at least one needle bar a predetermined distance less than 10% of the length of the at least one needle bar.

17. The tufting needle assembly of claim 9, wherein the at least one matched pair of front gauge elements are spaced from the respective outer ends of the at least one needle bar a predetermined distance less than 5% of the length of the at least one needle bar.

18. The tufting needle assembly of claim 9, wherein the front gauge elements extending between the respective at least one matched pair of front gauge elements are positioned in-line with respective back gauge elements with respect to the feeding direction of the tufting machine.

19. The tufting needle assembly of claim 4, wherein at least one matched pair of front gauge elements is spaced from respective adjacent front gauge elements on opposite sides of the midpoint of the at least one elongate needle bar at a distance between about 0.05 to about 0.51 inches.

20. The tufting needle assembly of claim 2, wherein the spacing between the first plurality of loopers is substantially the same as the spacing between the cooperating front gauge elements; and wherein the spacing between the second plurality of loopers is substantially the same as the spacing between the cooperating back gauge elements.

21. The tufting needle assembly of claim 1, wherein the first distance is between about 0.05 to about 0.50 inches.

22. The tufting needle assembly of claim 1, wherein the front gauge elements each comprise a tufting needle having an elongate needle shank with a proximal end and a spaced distal end defining a needle tip, and wherein the back gauge elements each comprise a tufting needle having an elongate needle shank with a proximal end and a spaced distal end defining a needle tip.

23. The tufting needle assembly of claim 22, wherein the distance between respective adjacent front and back gauge elements is measured between respective proximal ends of the adjacent gauge elements.

24. The tufting needle assembly of claim 22, wherein the distance between respective adjacent front and back gauge elements is measured between the respective distal ends of the adjacent gauge elements.

25. The tufting needle assembly of claim 22, wherein the shanks of the tufting needles are aligned with respect to one another and extend linearly along their respective front and back longitudinal axis.

26. The tufting needle assembly of claim 22, wherein the needle tips of the tufting needles are aligned with respect to one another and extend linearly along their respective front and back longitudinal axis.

27. The tufting needle assembly of claim 1, wherein the back longitudinal axis is spaced from the front longitudinal axis in the range of from about 0.125 to 1.00 inches.

28. The tufting needle assembly of claim 1, wherein the at least one needle bar comprises a front needle bar and a back needle bar, wherein the row of front gauge elements is disposed on the front needle bar and the row of back gauge elements is disposed on the back needle bar.

29. A tufting needle assembly for use with a tufting machine having a frame and at least one elongate needle bar supported on the frame and configured for reciprocating motion with respect to the frame and having a midpoint and opposed outer ends, the tufting machine having a feeding direction for a carpet substrate therethough the tufting machine, the tufting needle assembly comprising:

a row of back gauge elements disposed on the at least one needle bar, each back gauge element being spaced from adjacent back gauge elements along a back longitudinal axis that extends along the lengthwise dimension of the at least one needle bar, wherein each back gauge element is spaced from an adjacent back gauge element a first distance; and a row of front gauge elements disposed on the at least one needle bar, each front gauge element being spaced from adjacent front gauge elements along a front longitudinal axis that extends along the lengthwise dimension of the at least one needle bar, wherein each front gauge element is spaced from an adjacent front gauge element at least the first distance, wherein at least one matched pair of front gauge elements is formed from the at least one front gauge element of a first portion of the row of front gauge elements that is spaced from one respective adjacent front gauge element at the distance greater than the first distance and the at least one front gauge element of a second portion of the row of front gauge elements that is bar is spaced from one respective adjacent front gauge element at the distance greater than the first distance, and wherein each match pair of front gauge elements is spaced substantially equidistant from the midpoint of the at least one needle bar, wherein the at least one matched pair of front gauge elements comprises a plurality of matched pairs of front gauge elements, and wherein the distance between adjacent front gauge elements of each matched pair of front gauge elements increases as the gauge elements of the plurality of matched pairs of front gauge elements extend along the front longitudinal axis from the midpoint toward the respective outer ends of the at least one needle bar, wherein the front longitudinal axis is positioned substantially parallel to and forward of the back longitudinal axis relative to the feeding direction of the tufting machine.

30. The tufting needle assembly of claim 29, wherein the at least one needle bar comprises a front needle bar and a back needle bar, wherein the row of front gauge elements is disposed on the front needle bar and the row of back gauge elements is disposed on the back needle bar.

31. The tufting needle assembly of claim 29, wherein the first distance is between about 0.05 to about 0.50 inches.

32. The tufting needle assembly of claim 29, wherein at least one matched pair of front gauge elements is spaced from respective adjacent front gauge elements on opposite sides of the midpoint of the at least one elongate needle bar at a distance between about 0.05 to about 0.51 inches.

33. The tufting needle assembly of claim 29, wherein the front gauge elements each comprise a tufting needle having an elongate needle shank with a proximal end and a spaced distal end defining a needle tip, and wherein the back gauge elements each comprise a tufting needle having an elongate needle shank with a proximal end and a spaced distal end defining a needle tip.

34. The tufting needle assembly of claim 29, further comprising:

a first plurality of loopers configured to engage the plurality of front gauge elements; and a second plurality of loopers configured to engage the plurality of back gauge elements.

* * * * *